US005377385A

United States Patent [19]

Jornot et al.

[11] Patent Number: 5,377,385

[45] Date of Patent: Jan. 3, 1995

[54] DRAW FRAME, STORAGE DEVICE AND COILER, DELIVERY REGULATION

[75] Inventors: Erich Jornot, Seuzach; Raphael Wicki, Aadorf; Urs Keller, Seuzach, all of Switzerland

[73] Assignee: Maschinenfabrik Reiter AG, Winterthur, Switzerland

[21] Appl. No.: 856,951

[22] PCT Filed: Aug. 28, 1991

[86] PCT No.: PCT/CH91/00184

§ 371 Date: Jul. 19, 1992

§ 102(e) Date: Jul. 19, 1992

[87] PCT Pub. No.: WO92/05301

PCT Pub. Date: Apr. 2, 1992

[30] Foreign Application Priority Data

Sep. 20, 1990 [CH] Switzerland ..... 03051/90

[51] Int. Cl.[6] ..... D01H 5/32; D01G 31/00

[52] U.S. Cl. ..... 19/240; 19/159 R

[58] Field of Search ..... 19/0.2, 0.22, 0.23, 19/237, 238, 240, 149, 157, 159 R, 159 A, 236, 239, 260; 57/90

[56] References Cited

U.S. PATENT DOCUMENTS

| | | | |
|---|---|---|---|
| 3,035,311 | 5/1962 | Woodbury | 19/159 R |
| 3,320,642 | 5/1967 | Fronza et al. | 19/159 R |
| 3,435,485 | 4/1969 | Stiepel | 19/159 R |
| 3,703,023 | 11/1972 | Krauss et al. | 19/159 R X |
| 3,852,848 | 12/1974 | Feller | 19/240 |
| 3,862,473 | 1/1975 | Felix et al. | 19/240 |
| 4,100,649 | 7/1978 | Erismann et al. | 19/0.2 |
| 4,413,378 | 11/1983 | Mandl et al. | 19/258 |
| 4,653,153 | 3/1987 | Felix et al. | 19/240 |
| 4,852,218 | 8/1989 | Lenaertz | 19/159 A |

FOREIGN PATENT DOCUMENTS

| | | | |
|---|---|---|---|
| 0062185 | 3/1982 | European Pat. Off. . | |
| 0286769 | 10/1988 | European Pat. Off. . | |
| 0376002 | 12/1989 | European Pat. Off. . | |
| 0411379 | 7/1990 | European Pat. Off. . | |
| 0412448 | 2/1991 | European Pat. Off. . | |
| 0466049 | 7/1991 | European Pat. Off. . | |
| 2164564 | 8/1973 | France . | |
| 2204562 | 5/1974 | France . | |
| 2571066 | 4/1986 | France . | |
| 1145062 | 3/1963 | Germany | 19/159 R |
| 1931929 | 2/1971 | Germany . | |
| 1685627 | 9/1971 | Germany . | |
| 2230069 | 1/1973 | Germany . | |
| 2543839 | 11/1976 | Germany . | |
| 0017859 | 2/1991 | Japan | 19/159 R |
| 0462682 | 10/1968 | Switzerland . | |
| 1400246 | 7/1975 | United Kingdom . | |
| 15436857 | 7/1975 | United Kingdom . | |

OTHER PUBLICATIONS

Short Staple Spinning, vo. 3 ("A Practical Guide to Combining and Drawing"), p. 3.

*Primary Examiner*—Clifford D. Crowder
*Assistant Examiner*—Ismael Izaguirre
*Attorney, Agent, or Firm*—Sandler Greenblum & Bernstein

[57] ABSTRACT

An autoleveller draw frame achieves changes in the draft by changing the supply speed. The can press nevertheless works evenly. A storage device between the sliver calenders and the can press compensates for changes in the amount of supplied sliver. The storage device can be arranged in such a way that it allows a "flying change of cans." In one aspect, between the sliver calenders and the can press, the sliver forms a hanging loop which varies in depth, depending upon any changes in the supply speed of the sliver, while the can press operates relatively evenly and is not required to be accelerated or braked in response to changes in the supply speed. In another aspect, the storage device includes a conveyor belt arrangement between the supply of the sliver and the can press. Sliver loops are formed on an upper conveyor belt strand, whereafter they are deflected to a lower conveyor belt strand and then fed to the can press. The can press stretches the sliver loops on the lower conveyor belt strand as the sliver is received in the can. During a short period of time during the changing of cans, the sliver is no longer stretched on the lower conveyor belt strand, but is allowed to be maintained in loops, which represents an increase in the amount of sliver maintained at the storage device during can changing.

10 Claims, 7 Drawing Sheets

1
1.1
1.2
2
2.1
2.2
2.3
3
3.1
3.2
4
4.1
4.2
4.3
5
5.1
5.2
6
6.1
6.2
7.1
7.2
7.3
8.1
8.2
8a
8b
8c
8d
8e
9.1
9.2
9a
9b
10
10a
10b
11
12
13
15.1-15.6
16
17
18
TR
v1
v2
v3
v4
v5
v6
vin
vout
v1 = v2 < v3 = v4 < v5 = v6

DRAW FRAME, STORAGE DEVICE AND COILER, DELIVERY REGULATION

BACKGROUND OF THE INVENTION

1. Field of the Invention

The invention relates to a draw frame with a control means for compensating fluctuations in the mass of the sliver to be processed. The invention is particularly preferable in connection with draw frames in the called preparatory stage of a spinning mill, e.g. in drafting devices or combing machines.

2. Description of the Related

It has long been known, in particular in so-called autoleveller draw frame's, to compensate fluctuations the mass of a sliver (to be spun later on) by changing the draft in a controlled manner. A particularly preferable arrangement for carrying out such a process is shown in our Swiss Patent Application No. 2834/89 of Jul. 31, 1989. The transfer of this function to combing machine has been proposed in our European Patent Application No. 376 002.

In this context it is also known that the most difficult problems with respect to the process arise during the start-up and the braking of the draw frame. The importance of these start-up and braking problems are exacerbated by the continuously rising delivery speeds (with continuously rising productivity) of the respective machines. At a normal supply speed of 800 m/min the start-up and braking period for a draw frame is approx. 1 to 3 secs. If a defect sliver is produced because of problems in a control circuit within such a period, the defect can have an effect on the subsequent spinning of fine yarn up to a yarn length of approx. 700 to 2000 m.

The sliver treated in the draw frame has to be deposited in a so-called can for transportation between the processing stages. The draw frame usually has to be briefly turned off after the filling of a can for the purpose of changing the can, which requires a braking period and then a start-up period.

A control means for coping with the latter problem is the subject matter of our Swiss Patent Application No. 2537 of Jul. 13, 1990.

It is the task of a controlled draw frame, either in the drafting device of a combing machine or an other textile machine, to compensate to the utmost extent both long wave and short wave mass fluctuations of the sliver to be drawn. The compensation of long wave fluctuations does not cause any major problems, whereas the compensation of short wave fluctuations still does. In connection with the compensation of short wave mass fluctuations there are problems in respect of

- the measurement of the fluctuations,
- the (highly dynamical) drive of the drafting rollers in accordance with the measurements,
- the transformation of the roller speed to the suitable linear movement of the slivers.

From patent literature it is known that the change in the draft that is required for the compensation can be gained by controlling the delivery speed in a drafting device with two drafting zones (see, for example, the DE-OS 1 685 627). This arrangement, however, has not yet gained ground in general practice. The feed speed is usually changed instead. When feeding the machine, however, from a plurality of spinning cans, this arrangement can lead to complications in the feeding zone of the machine.

It is also known to provide the carding machine with a drafting arrangement comprising a single drafting zone in order to compensate sliver unevenness "at the source" by controlling the draft at relatively low supply speeds. Examples of such arrangements can be found in the CH-PS 462 682, DE-OS 22 30 069DE-AS 19 31 929 and DE-AS 25 43 839. Such "supplementary carding units" also comprise a storage means that is able to smooth the high-frequency changes of the supply speed before the transfer to the next processing stage. This arrangement, too, has never been employed in general practice for longer periods.

A storage means has not become known in combination with a high-speed draw frame (such as, for example, a frame according to US-PS 4 413 378 or EP-62 185).

Our own European Patent Application No. 376 002 provides the use of a storage means in combination with the control in the feed of a drafting device of a combing machine, but not in combination with the control of the delivery.

SUMMARY OF THE INVENTION

It is a object of the present invention to propose the overall arrangement of the drafting device and the units following said device, whereby said arrangement makes optimal use of the features of highly dynamical driving systems in accordance with CH 2834/89 or CH 2357/90.

A drafting device in accordance with a first aspect of the present invention includes a combination of the following features:

- in the feed zone a multiple doubling takes place, i.e. at least four and preferably six to eight slivers are introduced or means for introducing such a number of slivers are provided;
- the drafting device comprises both a predrafting zone as well as a main drafting zone;
- a driving means for the drafting device is provided;
- a (sliver) mass measuring unit is provided in the feed zone and a control means reacting thereto and acting upon the driving system in order to at least reduce mass fluctuations recognized by the measurement unit by way of changing the draft in the main drafting zone, whereby the supply speed (i.e. the delivery speed) is changed;
- the fleece supplied by the drafting device joined to a sliver or means for this purpose are provided;
- the sliver thus formed is intermediately stored in a storage means;
- a sensor is provided that reacts to the amount or the length of the intermediately stored sliver;
- a can press for depositing the sliver drawn from the storage means is provided, whereby the can press is integrated in the driving system;
- the said control means reacts to the said sensor and acts upon the driving system in such a way that either the feed speed is kept constant and the speed of withdrawing the stored sliver from the storage means by mean of the can press changes in a controlled manner in order to maintain the predefined sliver amount or sliver length in the storage means, or the feed speed is changed with the withdrawing speed from the storage means remaining constant, or both (feed and withdrawing speeds) are controlled in order to maintain the stored amount.

The invention is now outlined in greater detail by reference to FIGS. 7A, 7B and 8 of the drawings, whereby, at first, for the sake of completeness the concept of the drive in accordance with two previous Swiss Patent Applications will be outlined by reference to FIGS. 1 to 6.

DETAILED DESCRIPTION OF THE PREFERRED EMBODIMENTS

Figure 1:
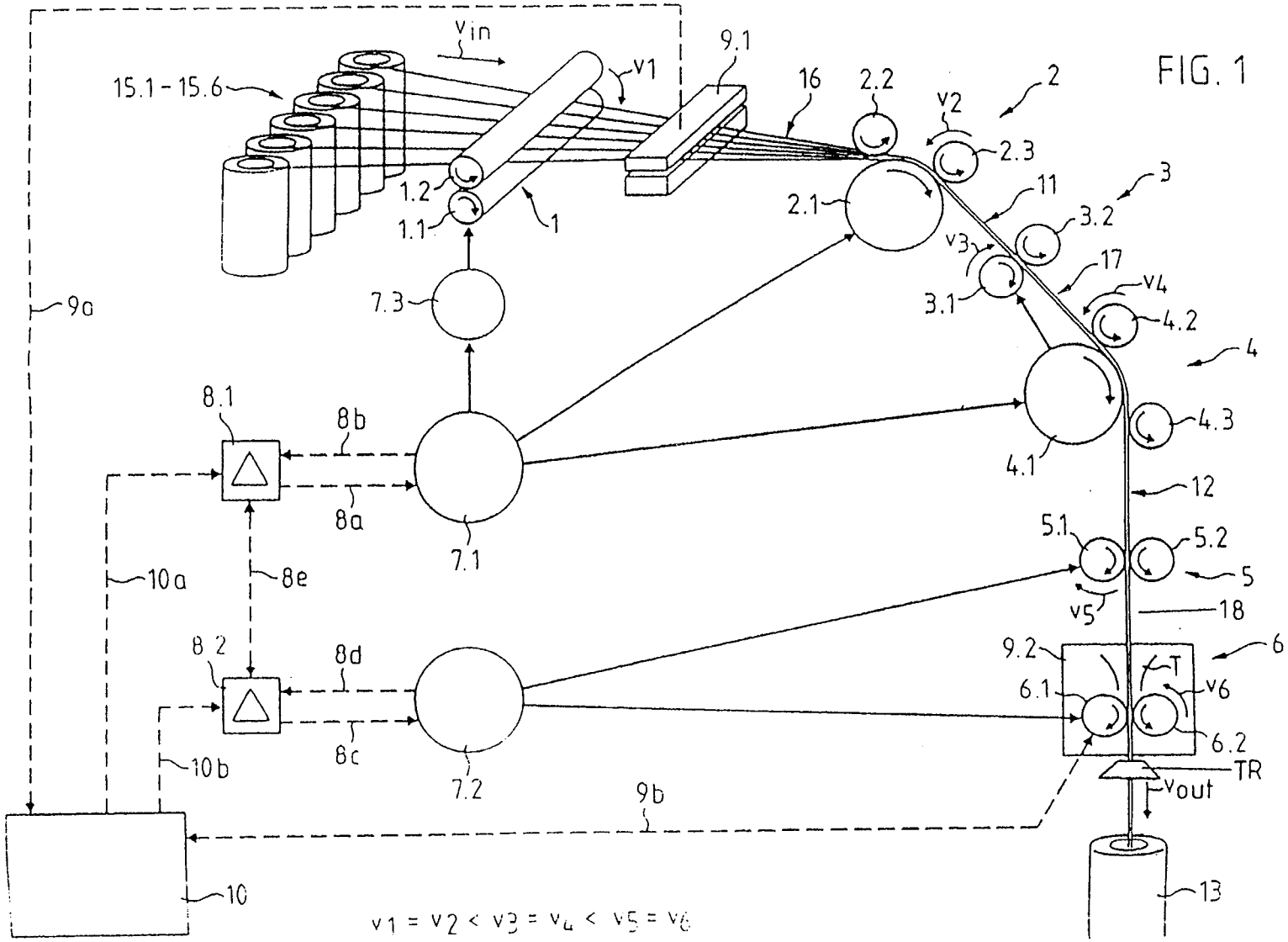
FIG. 1 schematically shows a driving system for a draw frame in accordance with our Swiss Patent Application No. 2834/89 of Jul. 31, 1989.

FIG. 1 shows a schematical view of the embodiment of a draw frame. In our European Patent Application No. 376 002 the application of a controlled drafting device in a combing machine is shown. The principles and systems described hereinunder may be applied both in the combing machine as well as the draw frame.

In the system in accordance with FIG. 1 several slivers 15.1–15.6, for example six, are disposed next to each other and are joined to form a loose fleece and guided through several roller systems 1–6. Due to the fact that the circumferential speed of the rollers increases in two stages in the conveying direction of the fibrous material, said material is predrafted over the first stage (predraft) and then further drafted (main draft) over the second stage until it reaches the desired cross section.

The fleece 18 leaving the draw frame is thinner than the fleece of the supplied slivers 15.1–15.6 and therefore said fleece is also longer. Due to the fact that the drafting processes can be controlled depending on the cross section of the supplied slivers, the slivers or the fleece are evened out during their passage through the draw frame, i.e. the cross section of the outgoing fleece is more even than the cross section of the supplied fleece or slivers. The present draw frame comprises a preliminary drafting zone 11 and a main drafting zone 12. Naturally, the invention can also be applied in an analogous manner in connection with draw frames with more than two drafting zones.

The slivers 15.1–15.6 are supplied to the draw frame via two systems 1 and 2 of conveying rollers. A first system 1 consists, for example, of two rollers 1.1 and 1.2, between which the supplied slivers 15.1–15.6 that are joined to form a loose fleece are conveyed. In the conveying direction of the slivers a system of rollers 2 follows, consisting here of an active conveying roller 2.1 and two passive conveying rollers 2.2, 2.3. While the slivers are fed by means of the roller systems 1 and 2, said fed slivers 15.1–15.6 are joined next to each other to form a fleece 16. The circumferential speeds $v_1$ and $v_2$ ($=v_{in}$) of all rollers of the two roller systems 1 and 2 of the feed are approximately identical, so that the thickness of the fleece 16 is substantially equivalent to the thickness of the fed slivers 15.1–15.6. A slight tensioning draft may be provided between the roller systems 1 and 2.

Following the two roller systems 1 and 2 of the feed there is a third system 3 in the conveying direction of the fleece 16, said system consisting of predrafting rollers 3.1 and 3.2, between which the fleece is further conveyed. The circumferential speed $V_3$ of the predrafting rollers is higher than the speed of the feeding rollers $v_{1,2}$, so that the fleece 16 in the predrafting zone 11 is drafted between the feeding rollers 2 and the predrafting rollers 3, which leads a reduction in its cross section. At the same time a predrafted fleece 17 comes about from the loose fleece 16 of the fed slivers. After the predrafting rollers 3 there is a further system 4 consisting of an active conveying roller 4.1 and two passive conveying rollers 4.2, 4.3 for further conveying the fleece. The circumferential speed $v_4$ of the conveying rollers 4 for further conveying the fleece is equivalent to the speed $v_3$ of the predrafting rollers 3.

After the roller system 4 for further conveying the fleece there is a fifth system 5 in the conveying direction of the fleece, said system consisting of main drafting rollers 5.1 and 5.2. The main drafting rollers, on the other hand, have a higher surface speed $v_5$ than the previous conveying rollers, so that the predrafted fleece 17 is drafted between the conveying rollers 4 and the main drafting rollers 5 in the main drafting zone 12 to form the finally drafted fleece 18, whereby the fleece 18 is joined to form a sliver through a funnel T.

Between a pair 6 of delivery rollers 6.1, 6.2, whose circumferential speed $v_6$ ($=V_{out}$) is equivalent to the speed of the previous main drafting rollers ($v_5$), the finally drafted sliver 18 is removed from the draw frame and deposited in rotating cans 13.

This arrangement is equivalent to our European patent No. 62 185. The invention is not limited to this arrangement. However, it is provided for the use in combination with a high-speed drafting device (supply speeds higher than 700 m/min).

In accordance with our Swiss patent application No. 2834/89 the roller systems 1, 2 and 4 are driven by a first servomotor 7.1, preferably by means of a toothed belt. The predrafting rollers 3 are mechanically coupled with the roller system 4, whereby the transmission can be adjustable or a scheduled value can be set. The gear (which is not shown in the FIG.) determines the ratio between the circumferential speeds of the feeding rollers ($v_{in}$) and the circumferential speed $v_3$ of the predrafting rollers 3.1, 3.2, i.e. the predrafting ratio.

The roller systems 5 and 6 are driven by a servomotor 7.2. The feeding rollers 1.1, 1.2 can also be driven by said first servomotor 7.1 or, optionally, by an independent motor 7.3. The two servomotors 7.1 and 7.2 each comprise an own controlling means 8.1 and 8.2 respectively. The control is carried out for each of them by means of a closed control loop 8.*a*, 8.*b* or 8.*c*, 8.*d* respectively. In addition, it is possible that the actual value of the one servomotor is transmitted to the other servomotor in one direction or in both directions via a control link 8.e, so that each servomotor can react in a pertinent manner to fluctuations in the respective other servomotor. At the same time, the motor 7.2 can be arranged as the master motor and the motor 7.1 can be arranged as the slave motor which follows the master motor. Depending on the respective arrangement it is also possible that the motor 7.1 is arranged as the "master". The master receives from the computer 10 a predetermined speed to be adhered to and the slave follows the master by means of a position controlling means with the simultaneous activation of the draft control means.

In the feeding zone of the draw frame the mass or a value equivalent to the mass, e.g. the cross section of the fed slivers 15.1–15.6, is measured by feed measuring unit 9.1. At the end of the draw frame the cross section of the outgoing sliver 18 is measured by a delivery measuring unit 9.2.

The concept of the drive will be explained in greater detail by reference to FIG. 2 which shows an arrangement of FIG. 1 with its control means.

A central processing unit 10 transmits an initial setting of the scheduled value for the first drive via 10*a*. to the first control means 8.1. The measured values of the two measuring units 9.1, 9.2 (FIG. 1) are continuously transmitted via links 9.*a* and 9.*b* to the central processing unit during the drafting process. The scheduled value for the servomotor 7.2 is determined in the central processing unit or other optional units from said measured values and from the scheduled value for the cross section of the outgoing sliver 18. This scheduled value is continuously transmitted via 10.*b* to the second control means By means of this control system ("the main control unit") it is possible to compensate fluctuations in the cross section of the fed slivers 15.1–15.6 by a respective control of the main drafting process or to achieve the evening out of the sliver.

The two servomotors 7.1 and 7.2 serve in the present invention as the main driving means. The servomotor 7.1 drives the roller system 1 of the feeding section and the system 4 of the conveying rollers, whereby said system 4 follows the predrafting section. The pair of predrafting rollers 3 is mechanically coupled with the roller system 4 and is therefore also driven by the servomotor 7.1. The pair of rollers 1 in the feeding zone is either driven via an intermediate drive 7.3 (gear) by the servomotor 7.1 or can be driven in another embodiment of the drive of the draw frame by an independent servomotor 7.3. The servomotor 7.2 drives the pair of main drafting rollers 5 directly. The pair of draw-off rollers 6 is also driven by the servomotor 7.2 through a gear 7.4. The drive of can 13 at the output of the drafting device will now be explained below by reference to FIGS. 7 and 8.

The concept of the drive in accordance with the Swiss Patent Application No. 2834/89 is based on the fact that at least one group of drives within the draw frame is independently driven by a controlled motor. This also constitutes the preferable concept of the drive for an arrangement of the drafting device in accordance with the present invention. For each independent group of drives of a drafting zone or, if required, also a conveying zone or any other work stations that are coupled in accordance with the process it is possible to provide a controlled motor for each of said units. In the shown example there are two such motors, i.e. the motors 7.1, 7.2 of the predrafting zone 11 and the main draft zone 12. Errors caused by the drives can principally be compensated within the framework of the control unit that controls the whole system, i.e. the main control unit. It has, however, been seen that it is preferable if each group of drives is controlled individually, i.e. an underlaid control unit with the respective controllers 8.1, 8.2 is to be provided. Of particular importance is the fact that any occurring control deviations of the overall system are influenced in a preferable manner and that better time dependencies are created and possible malfunctions are precompensated. Such drive units whose control is supported by means of controllers 8.1, 8.2 can be applied in various concepts of main control units.

The drive of the drafting device is controlled on two levels. One of these is the higher-ranking main control unit 9.*a*, 9.*b*, 10.*a*, 10.*b* in which the central processing unit 10 assumes an essential function. The other is the underlaid auxiliary control unit 8.2 for the main drafting zone. In the present invention two controllers 8.1 and 8.2 are provided for the auxiliary control unit of the main drafting zone (including the delivery zone) and the predrafting zone (including the feeding zone). In the mentioned embodiments it is also possible that additional controllers 8.3, 8.5 are provided, which are shown in broken lines in the present invention. In connection with the two servomotors, which, for example, can be arranged as brushless D.C. motors, positioning controllers are preferably used. The intermeshed control system comprising a main control unit and at least one auxiliary control unit relieves the central processing unit 10 and reduces the danger of large strokes in the main control unit.

The main control unit 9.*a*, 9.*b*, 10.*a*, 10.*b* supplies scheduled values, e.g. scheduled speed values, via 10.*a* or 10.*b* to the main drive motors 7.1 or 7.2, whereby said values are calculated from the scheduled cross section of the outgoing sliver and the measured actual cross section of the fed sliver(s) 9.*a* and the outgoing sliver 9.*b*. Depending on the arrangement of the control unit it is possible that other parameters are taken into consideration.

By means of the auxiliary control loops 8.*a*–8.*k* the speeds of the individual drive motors 7.1 and 7.2 (for the embodiments also 7.3 and 7.5) are controlled in closed positioning control loops 8.*a*, 8.*b* and 8.*c*, 8.*d* (in the embodiments also 8.*f*, 8.*g* and 8.*i*, 8.*j*) to the scheduled values required by the superior control levels. Differences between the actual values and the scheduled values of the motor speeds are transmitted between the positioning control units 8.1, 8.2 via a control link 8.*e* (possibly also 8.*k* and 8.*h*). It can also be provided that if a deviation between the scheduled value and the actual value of the speed of the respective motor occurs and if said deviation lies outside of the controlled range of the respective controller 8.1 and 8.2 (and possibly also 8.3 and 8.5), said deviation can be compensated by the positioning control units of the other motors by making pertinent corrections in the scheduled values for the speeds of said other motors. In this event it is possible to provide the respective feedbacks to the central processing unit 10. In a preferred embodiment this correction takes place internally in the respective controllers, i.e. the master control unit, for example, is provided with a new scheduled value.

The drive motors defining the draft each form position-controlled drive systems in combination with their respective control loops. For this purpose each motor can be provided with an encoder or with a resolver which supplies the angular position of the drive shaft as the current value to the positioning control unit for this motor. The control unit of the drafting device can thus match the angular positions of the motor shafts to one another and therefore match the angular positions of the rollers of the drafting device driven by said motor shafts.

Such a drive system offers a better drafting precision than systems using speed-controlled motors. There are advantages during the start-up or braking of the draw frame, because it is possible to improve the controlling precision in the event of slow speeds right up to the standstill.

Controllers preferably used as auxiliary control units are positioning controllers in accordance with the Swiss Patent Application No. 2357/90, as said controllers guarantee the position even in the event that the motor has come to a standstill. The respective controllers 8.1, 8.2 (or possibly further controllers within the scope of variations of embodiments) may comprise separate computer units (for example with digital signal processors or microprocessors) or it may be arranged as a module of the central processing unit 10.

The concept of the drive therefore starts out from the fact that independent drive units or drive groups of the draw frame are controlled separately. A drive group in this context means a unit that comprises at least one motor including the rollers or guiding rollers or conveying rollers. Such a drive group is represented, for example, in the embodiment in accordance with FIG. 2 showing the group 7.2, 7.4, 7.5, 5 and 6 containing the motor 7.2. A preferred embodiment of the draw frame provides a digital synchronizing control unit for the drive groups for the nominal settings (supply and draft). One drive group serves as the master drive unit. The control of a drive group can be achieved by changing the nominal setting.

This allows the user to provide only the scheduled value for the actuating variable (speed ratios), i.e. the value or correcting variable for the draft. In addition it must be taken into account that the main control unit is to compensate both short-term as well as long-term malfunctions. The shown drive system allows an intermeshed control and thus makes use of the improved time dependence. The control links **8.*e*, 8.*h*, 8.*k* also provide the system with shorter reaction periods. Fluctuations in the drive systems therefore do not have to be registered first through a closed main control loop of the master computer 10**, which would entail respective idle times.

Such a separate control for each of the drive groups has decisive advantages also in the event that several drafting zones are provided, of which, however, only one or a part thereof have to be or are to be controlled. The zones with constant draft can be operated by providing only a scheduled value without having to control them by the main control unit.

Figure 2:
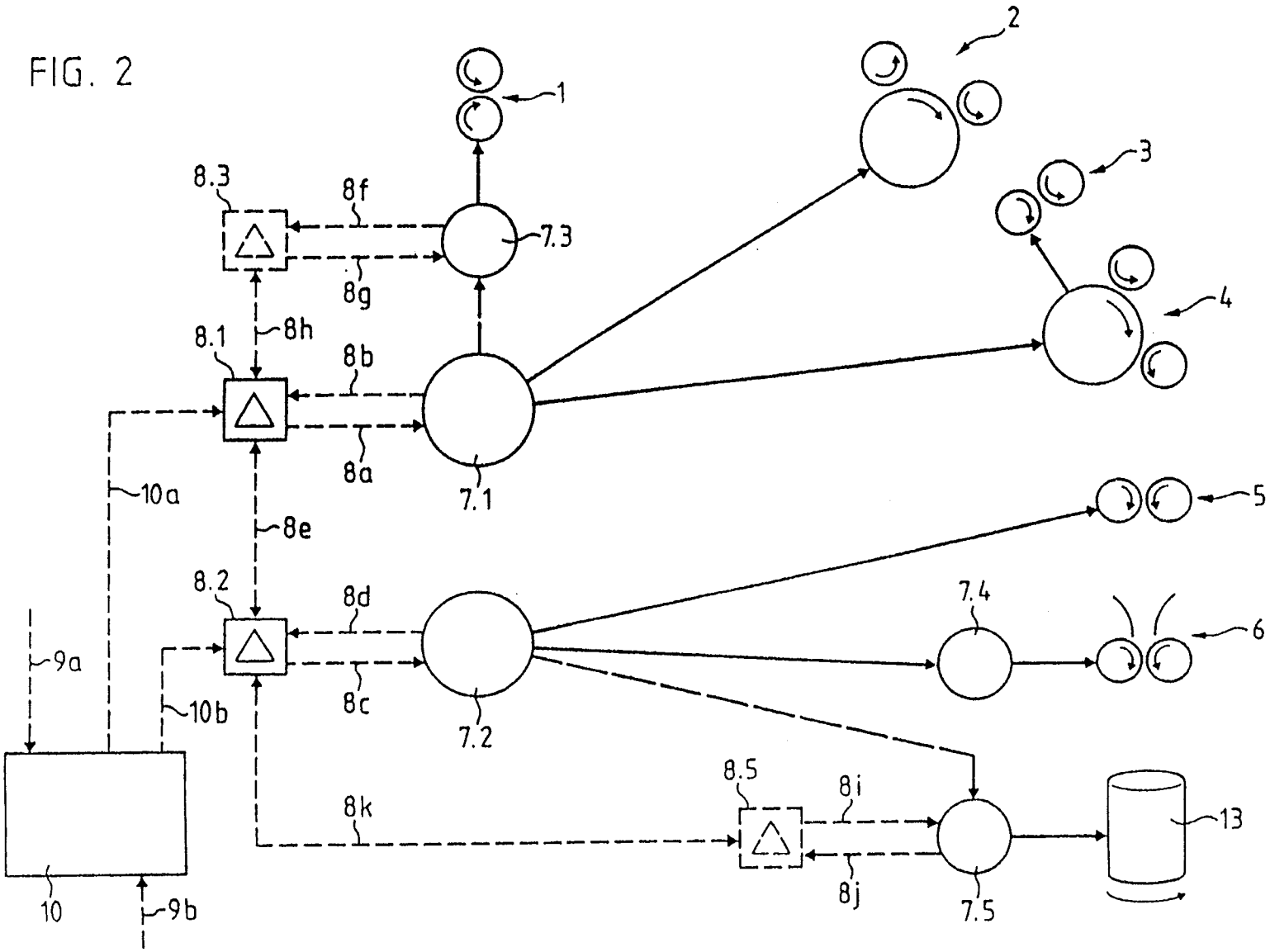
FIG. 2 shows an overview of the arrangement of the drive and the respective-controlling means of a draw frame in accordance with FIG. 1

The control principle shown in FIGS. 1 and 2 ensures a very good evening out also in the event that there are unforeseeable changes in the operating conditions. Both short-term malfunctions as well as gradual changes can be optimally compensated within the scope of this control system. The actuating variable established by the main control unit, which is used here, for example, for the main draft, serves as the input variable for the respective controller 8.2.

Figure 3:
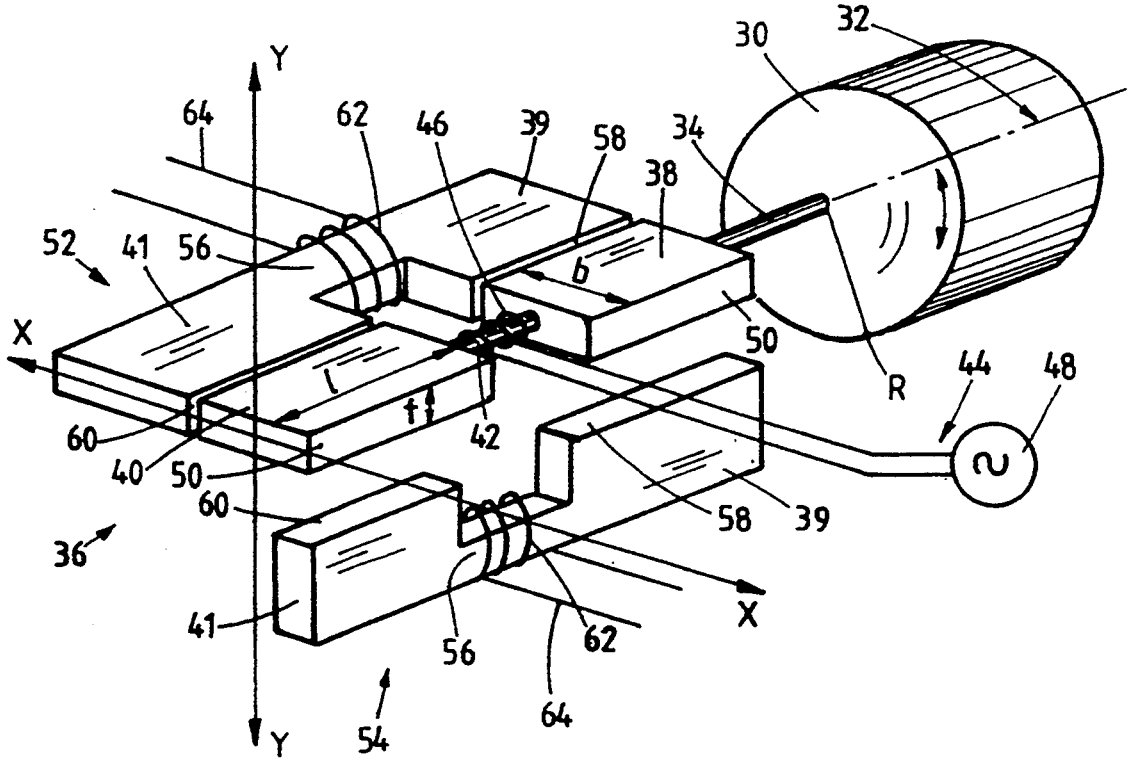
FIG. 3 schematically shows a position sensor for a control loop in accordance with our Swiss Patent Application No. 2357/90 of Jul. 13, 1990.

FIG. 3 schematically shows a position sensor for use in closed control units **8*a*, 8*b*, and 8*c*, 8*d* of FIGS. 1 and 2. The reference sign 30 indicates the armature of, for example, motor 7.1 (FIG. 1). In the event of suitable excitation of the stator windings the armature 30 rotates about its own longitudinal axis 32. The armature 30 is connected to a shaft 34 carrying a field-generating element 36. The element 36 comprises two "shoes" 38, 40 consisting of a ferromagnetic material (e.g. steel) or a material with respective field-influencing qualities. The shoe 38 is directly mounted on the shaft 34, whereas the shoe 40 is carried by the shoe 38 through an intermediate element (pin) 42**.

A conductor 44 for electric current comprises some windings 46 which encircle the intermediate element 42. If the conductor 44 is fed with current from a suitable source 48, an electromagnetic field is generated in the intermediate element 42, whereby the field is influenced by the shoes in such a way that the field generated in the zone is arranged in a predetermined manner.

The electromagnetic field generated by the windings 46 in the pin 42 is dynamically balanced. In the transitional area of pin 42 to the shoes 38, 40 the dynamical balance is nullified by the shape of the shoes. Each shoe is a flat element with a thickness t which is substantially smaller than the axial length 1 or the width b of the element. The effect of the said flat shape of the shoes 38, 40 is such that in the transitional area of the pin 42 to the shoes the electromagnetic field preferably expands in directions that lie within said shoes. This means that the field comprises preferable directions which are schematically indicated by the arrows X in FIG. 3. These directions are preferable in the sense that when the shoes 38, 40 turn about the longitudinal axis 32 of the armature 30, the electromagnetic coupling with a field-sensitive element is much stronger in the directions X than the in directions Y which are vertical to the directions X.

Each shoe 38, 40 has two surface 50 (only one surface 50 can be seen in each shoe in FIG. 3) which radially show outwardly. When the armature 30 (and therefore the shoes 38, 40) turn about the axis 32, each pair of surfaces 50 describes an orbiculate cylinder, which is hereinafter referred to as "sheet". Two field-sensitive elements 52, 54 are located as closely as possible near the sheet of the shoes 38, 40. Each element 52, 54 comprises two shoes 39, 41 and a connecting rod 56. Each shoe 39 has a surface 58 which is equivalent in its shape and dimensions to the surfaces 50 of shoe 38 and which is located as closely as possible to the sheet of shoe 38. In the same manner each shoe 41 comprises a surface 60 whose shape and dimensions are equivalent to those of the surfaces of shoe 40 and which are located as closely as possible near the sheet of shoe 40. The surfaces 58, 60 of element 52, however, are vertical to the surfaces 58, 60 of element 54. This means, however, that the electromagnetic coupling between the shoes 38, 40 and the element 52 reaches its maximum intensity at a time at which the electromagnetic coupling between the shoes 38, 40 and the element 54 reaches the minimum intensity.

Around the connecting rods 56 of elements 52, 54 there are windings 62 of the respective signal conductor 64 which convey the output signals from the field-sensitive elements to the evaluation means. The signal intensity in the conductor 64 of element 52 is therefore at its peak at the same time at which the signal intensity is at its lowest in the conductor 64 of element 54 and vice versa.

It is now assumed that source 48 generates an A.C. current with a sinusoidal waveform. The A.C. current in the windings 46 produces an electromagnetic field in the pin 42 and in the shoes 38, 40. The electromagnetic field is coupled with the two output lines 64 through the two pairs of shoes 39, 41, so that the input signal originating in source 48 excites an output signal consisting of two components, i.e. a component in the conductor 64 of element 52 and a second component in conductor 64 of the element 54. The signal intensity of these two components is not only a function of time (depending on the input signal generated by the source 48), but it is also a function of the angular position of the shoes 38, 40 about the axis 32 in accordance with the relations $$A = \sin \psi \sin \omega t$$

$$A = \cos \psi \sin \omega t,$$

whereby A and B are the two output signal components, $\psi$ constitutes a measure for the angular position of the shoes and $\omega$ t are the conventional characteristic values for a sinusoidal wave.

As both components A, B of the output signal directly depend on the input signal, it is possible by means of suitable evaluation to filter out the influence of the input signal and to gain a signal which is only a function of the angular position of the shoes 38, 40. As, however, the carrier wave (i.e., the input signal generated by the source 48) is time variable, the two components A, B of the output signal also come about in the conductors 64 in the event that the armature 30 (and therefore the shoes 38, 40) does not move. This means that the angular position of the shoes 38, 40 can also be evaluated in the event that the motor with the armature 30 is not excited.

Figure 4:
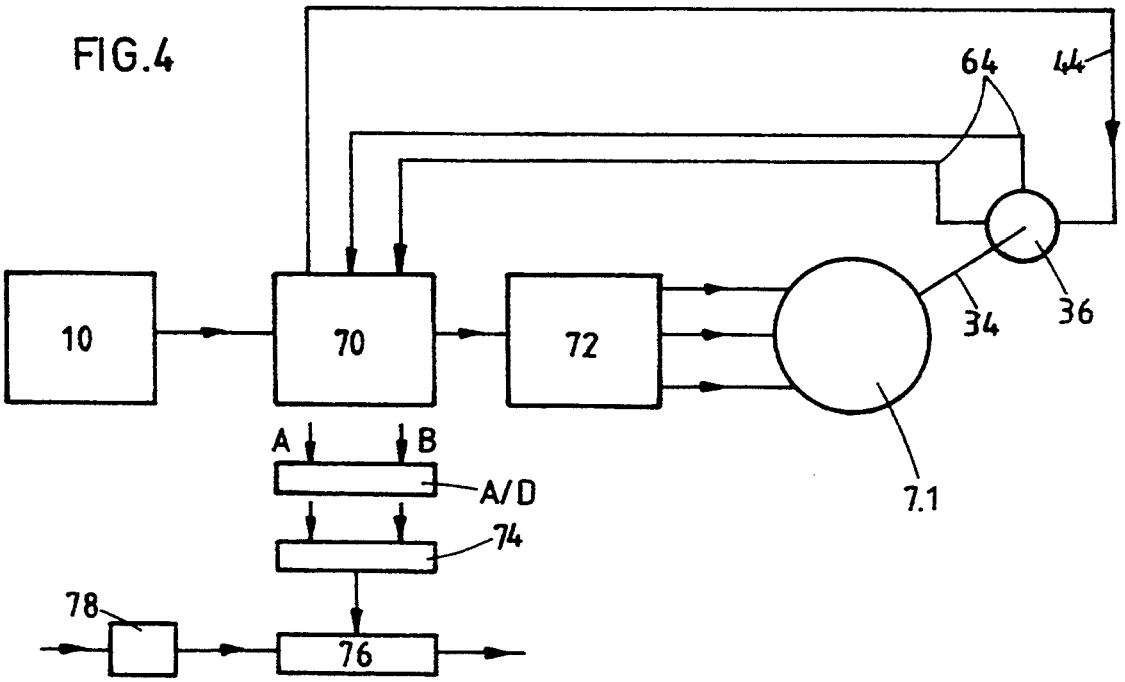
FIG. 4 schematically shows a control loop with a sensor in accordance with FIG. 3.

If the position of an object can be determined at any time and can be represented by a suitable signal, there is the possibility, in the event of a change in this position, to derive the speed of the movement (in the event of a rotary movement the number of rotations per time unit) by forming a differential equation. This differentiation can also be carried out in the evaluation, which will now be outlined roughly below by reference to FIG. 4.

FIG. 4 again shows the motor 7.1 and schematically the sensor 36 with the connecting shaft 34 and the two output lines 64. These two lines each supply their signal components to an input of a microprocessor 70. This processor receives a further input signal from a central control unit 10 (see also FIG. 1) and supplies a control signal to a motor controller 72. Based on the said signal the motor controller 72 determines the power supplied by the motor 7.1.

The operations carried out by the microprocessor 70 are determined by the programming of the processor. For the purpose of explaining these operations the main steps are figuratively described in FIG. 4A as "hardware elements". In accordance with the description, the two signal components supplied by the sensor 36 are converted by an analog-to-digital converter A/D into the respective digital signals and forwarded to a divisor 74. The divisor 74 forms, for example, the value tan A/B and forwards the respective signal to a comparator 76. The current (actual) value for the angular position of the shoes 38, 40 is compared with a scheduled value in the comparator, said scheduled value being provided in a suitable storage means 78. A difference (deviation) between the scheduled and the actual value is represented by the comparator 76 in the form of a deviation signal and supplied to the motor controller 72 for controlling the motor performance.

The scheduled value in the memory 78 can be altered depending on the programming, whereby the dependence consists of an active program that is determined in the central control unit 10 and of machine settings that are entered in the central control unit 10. An example of an active program is schematically shown in FIGS. 5 and 6.

Figure 5:
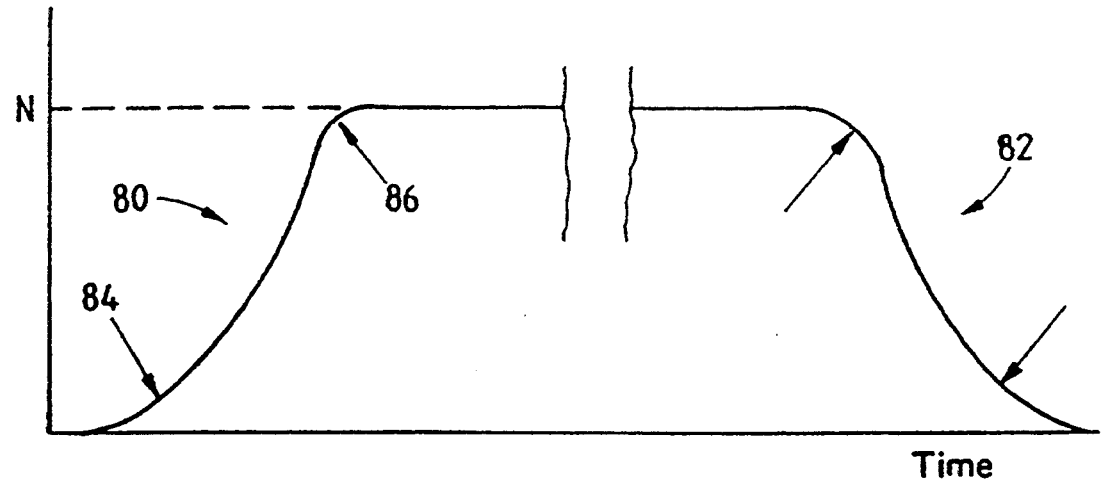
FIG. 5 shows the start-up or braking curves for a draw frame in accordance with FIG. 3.
Figure 6:
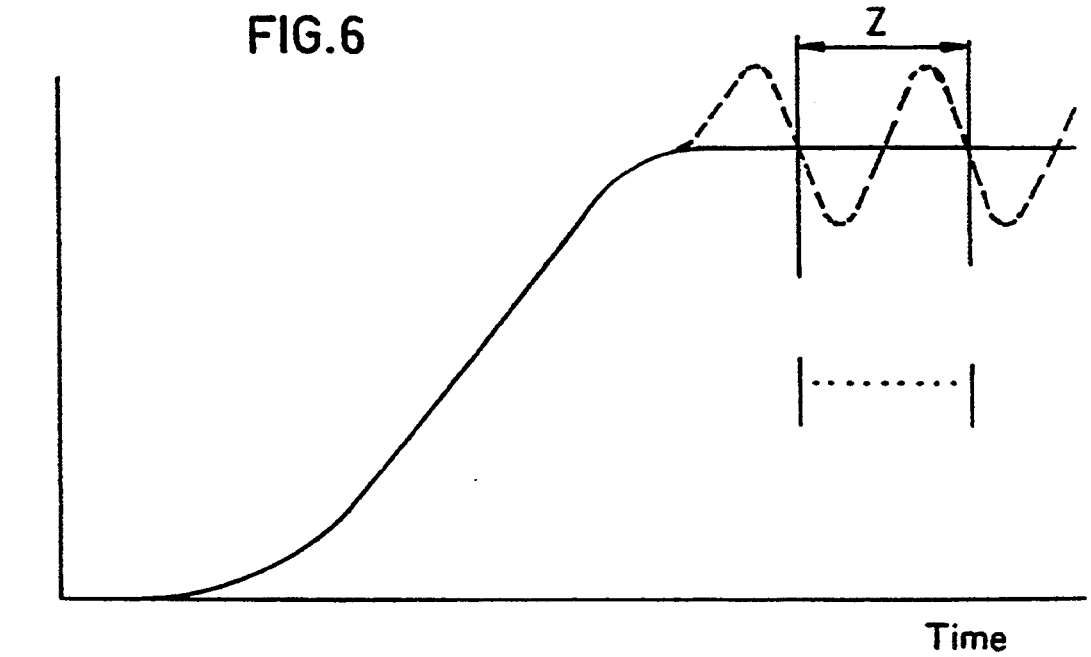
FIG. 6 shows a diagram for explaining the requirements of the evaluation of a control loop in accordance with FIG. 3.

FIG. 5 shows the start-up 80 from the standstill to a constant operating speed N and the subsequent braking 82 until the standstill. The normal operation has been largely removed from the diagram, because this condition has no importance in connection with FIG. 5. The following explanations are made in connection with the start-up 80, whereby they also apply in connection with the braking 82.

It is desirable to have a start-up curve with a controlled transition 84 from the standstill, a central portion with a constant rise (constant acceleration) and a controlled transition 86 to the operating speed N. The constant rise of the central portion of this curve and the controlled transition 86 to the operating speed N presently no longer constitute a major problem for systems in accordance with the state of the art. The problems arise from the transition 84 to the standstill. In this context it is not sufficient to provide only a position controlling means for the drive motor if the generation of an output signal of the position sensor of said controlling means depends on the speed of the motor armature. It is practically impossible to precisely trace the "position" of the armature up to the standstill. The sensor 36, which is schematically shown in FIG. 3, does not depend on the relative movement of the shoes 38, 40 with respect to the field-sensitive elements 52, 54 for generating an output signal. This sensor also supplies a position signal also in the event that the motor armature 30 does not move. A signal which depends on the speed of the motor can also be derived from the respective changes in the output signal of sensor 36 even at very low speeds of the armature 30.

The invention therefore allows the precise control of the motor speed during the start-up and the braking and offers the respective advantages even if there is only one motor. The invention is particularly advantageous, however, if there are two or more motors (see FIG. 1) and if a precise ratio between the speeds of said motors has to be adhered to in all operational conditions, i.e. also during common start-up and braking phases. As is well known, this is the case in drafting devices.

It was assumed in FIG. 5 that it is only necessary to carry out a preprogrammed operating curve. In the practice this is the case for one drive group (group of rollers) which operates with a constant speed in normal operation. In an autoleveller draw frame, however, the speed of at least one drive group must also be changeable after reaching the programmed speed N in order to compensate fluctuations in the mass of the processed sliver by carrying out changes to the draft. This is schematically outlined in FIG. 6, whereby for simplicity's sake a sinusoidal change (broken line) in the operating speed N of the respective drive group is assumed. An autoleveller draw frame which operates at supply speeds of at least 800 up to 1200 m/min. and which must be able to compensate short wave fluctuations in mass must be able to carry out sinusoidal changes in speed (as is shown in FIG. 6 by the broken line) within a period of maximally three millisecs. In order to ensure this with a closed control loop in accordance with FIG. 4, the scanning rate of the A/D converter shall be at least 3 kHz, so that each cycle Z (FIG. 6) of an (imagined) sinusoidal change in speed is scanned at least ten times and compared with the respective scheduled value.

The arrangement in accordance with FIG. 3 supplies a position signal which is equivalent to the angular position of an arbitrary circumferential point on the motor armature (e.g. of the circumferential point R, FIG. 3) with an uncertainty ±180°. Hence, based on the position signal of sensor 36 it is not possible to determine whether point R is located at the present or diametrical position. A differentiation between these two options is not necessary for the use in a drafting device controller. If, however, it seems to be necessary in certain cases, a position signal can be gained by suitable arrangement of the field generator (the shoes 38, 40) and a respective adjustment of the field-sensitive elements 52, 54, whereby said position signal provides both the direction and the angular position of the motor armature.

As was already described in connection with FIG. 1, the main draft (between the pairs of rollers 4.1/4.3 and 5.1/5.2) is changed in order to compensate fluctuations in the mass of fleece 16 (FIG. 1) before said mass leaves the draw frame. In accordance with a preferred feature of this invention the change in the draft is caused by continuous changes of the speed of the pair of rollers 5.1/5.2 with the speed of the pair of rollers 4.1/4.3 remaining constant (or at least being changed relatively slowly). This means continuous changes of the linear supply speed of the fleece leaving the pair of rollers 5.1/5.2. The changeability of the supply speed does not constitute a problem for the silver-forming unit (funnel TR and the draw-off rollers 6.1/6.2), so that (as was already mentioned) the pair of rollers 6 can be driven by the same motor 7.2 like the delivery rollers 5. The revolving plate 212 (FIG. 7A) for the can 13, however, cannot follow the high-frequency components of the roller movements. Without additional measures there is thus the risk of wrong drafts between the pair of rollers 6 and the can 13, which can lead to unevenness in the sliver. In a preferred embodiment of the present invention the revolving plate 212 is driven by its own motor 7.5 (see also FIG. 2). In any case, a storage means 202 (FIG. 7A) is provided between the sliver-forming unit and the can.

Figure 7A:
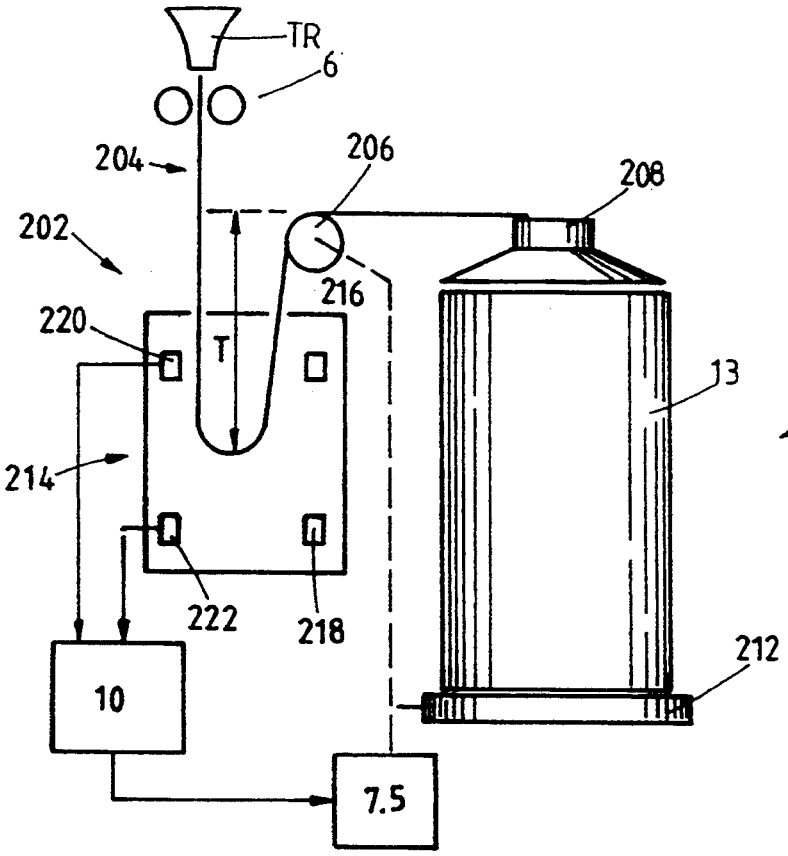
FIG. 7A shows a schematical view of the first embodiment of the delivery or depositing zone of a drafting device in accordance with a first aspect of this invention.

The arrangement in accordance with FIG. 7A is particularly suitable for a high-performance drafting device with an architecture in accordance with our European Patent No. 62185. The sliver 204 leaving the pair of rollers 6 is supplied directly downwards before it is deflected upwardly again and guided over a guiding roller 206 to the funnel wheel 208 of the can press 210. The can press, which is of conventional design and therefore need not be described in greater detail, comprises a revolving plate 212 which can be turned by the motor 7.5 (see also FIG. 2) about a vertical axis. By suitably controlling the speed of the revolving plate 212 in relation to the speed of the funnel wheel 208 it is possible (as is well known) to form regular windings of the sliver 204 in a can 13 (that also rotates) carried by the revolving plate 212.

The sliver portion between the pair of rollers 6 and the guiding roller 206 forms a U-shaped loop with a "depth" T which depends on the supply speed of the drafting device (i.e., the pair of rollers 6) and the "intake speed" of the can press 210, i.e. the speed with which the sliver is received by the can press from said loop. As was already mentioned, it is necessary (for compensating short wave fluctuations in the mass of the sliver in the feed zone) when controlling the draft by means of the delivery speed to subject the pair of delivery rollers to high-frequency changes in speed. The can press, on the other hand, should operate as evenly as possible, because the can has to accelerate or brake relatively large masses.

The sliver loop therefore constitutes a storage means that "buffers" the can press 210 in respect of the drafting device. The depth T is therefore variable during the operation. The intake speed of the can press 210 is equivalent to the mean supply speed of the drafting device. The high-frequency changes of this supply speed lead to shortenings or extensions of the sliver loop. As, however, these high-frequency changes are distributed statistically evenly around the mean value, they compensate one another over a short period, which also applies to the changes in the depth of the sliver loop.

If the condition mentioned last no longer exists, e.g., because of a persisting, small misadjustment of the intake speed of the can press in respect of the mean supply speed of the drafting device, a continuous extension or shortening of the sliver loop takes place. This, however, can only be tolerated up to a certain degree.

In order to determine and correct such "long-term effects" a monitoring means 214 is provided for the sliver loop. This monitoring means consists in the shown example of two light barriers, each comprising a light emitter 216, 218 and a light receiver 220, 222. The upper light barrier 216, 220 determines that the shortening of the sliver loop has traveled beyond acceptable tolerance limits and transmits a respective signal to the control unit 10 (see also FIG. 1 and 2). The lower light barrier 218, 222 determines an unacceptable extension of the sliver loop and also reports this to the control unit 10. Said control unit 10 initiates in both cases a suitable (small) change in the speed of the motor 7.5, so that the undesirable tendency with respect to the sliver loop length is corrected.

In such an arrangement it is also advisable to drive the guiding roller 206 in accordance with the speed of the revolving plate. This can be achieved by a suitable link (broken line) with the drive motor 7.5.

Figure 7B:
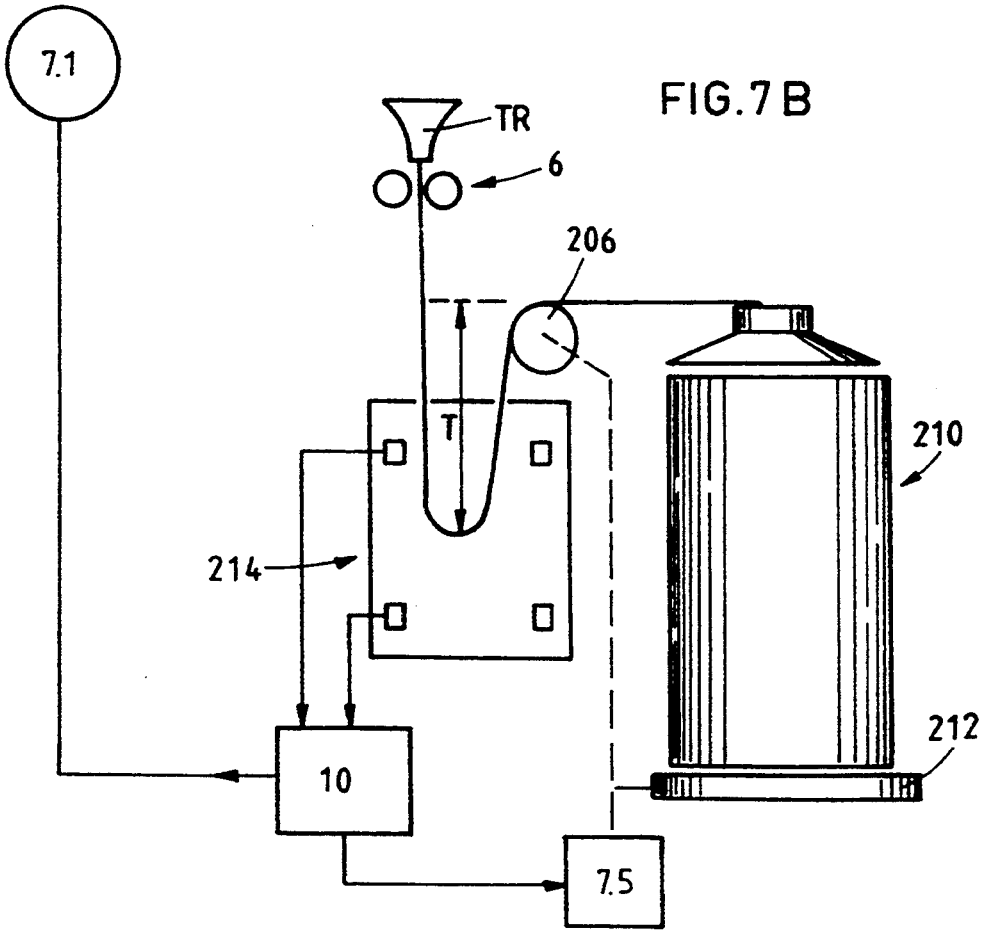
FIG. 7B shows a respective schematical view of a further variation of the first aspect of the present invention.

FIG. 7B shows the same elements as FIG. 7A and they have the same drawing references. FIG. 7B, however, shows in addition the link between the central control unit 10 and the motor 7.1 which determines the feed speed of the sliver mass in the drafting device. This feature intends to stress the fact that the length of the stored sliver loop can be stabilized not only by changing the intake speed of the can press 210, but (as an alternative or supplementary feature) by the slow (long-term) change of the feed speed. A change of this speed also causes a change of the mean supply speed. By scanning the sliver loop length it is therefore possible to adjust the mean supply speed of the drafting device to the intake speed of the can press by adjusting either the one or the other or both (also see FIG. 2).

As was already described in the introduction, it is usually necessary nowadays to turn off the can press (and therefore the drafting device) when changing cans in the draw frame. A flying change is possible in the carding machine (if lower supply speeds are used) and this would also be desirable for draw frames. The problem was formerly due to the substantially higher supply speeds of the draw frame in normal operation. As the time required for changing the cans can only be shortened up to a certain limit, the draw frame would at least have to be braked for the change, which could be carried out with a drive in accordance with the application No. 2834/89 with less technological risks than with a conventional drive. Despite the advantages of the drive in accordance with the application No. 2834/89 or No. 2357/90, the interruption or disturbance of the operation for changing the cans is not desired.

In accordance with a second aspect of the invention such a storage means is provided between the delivery zone of a draw frame and the feeding zone of a can press, so that during a change of the can and while maintaining the normal (operating) supply speed the supplied sliver is received by the storage means and the supplied sliver up to the next change of the can, i.e. the stored amount of sliver, is retained at the storage means. This second aspect of the invention can preferably be combined with the first aspect. An embodiment of the second aspect of the invention is shown in FIG. 8.

Figure 8:
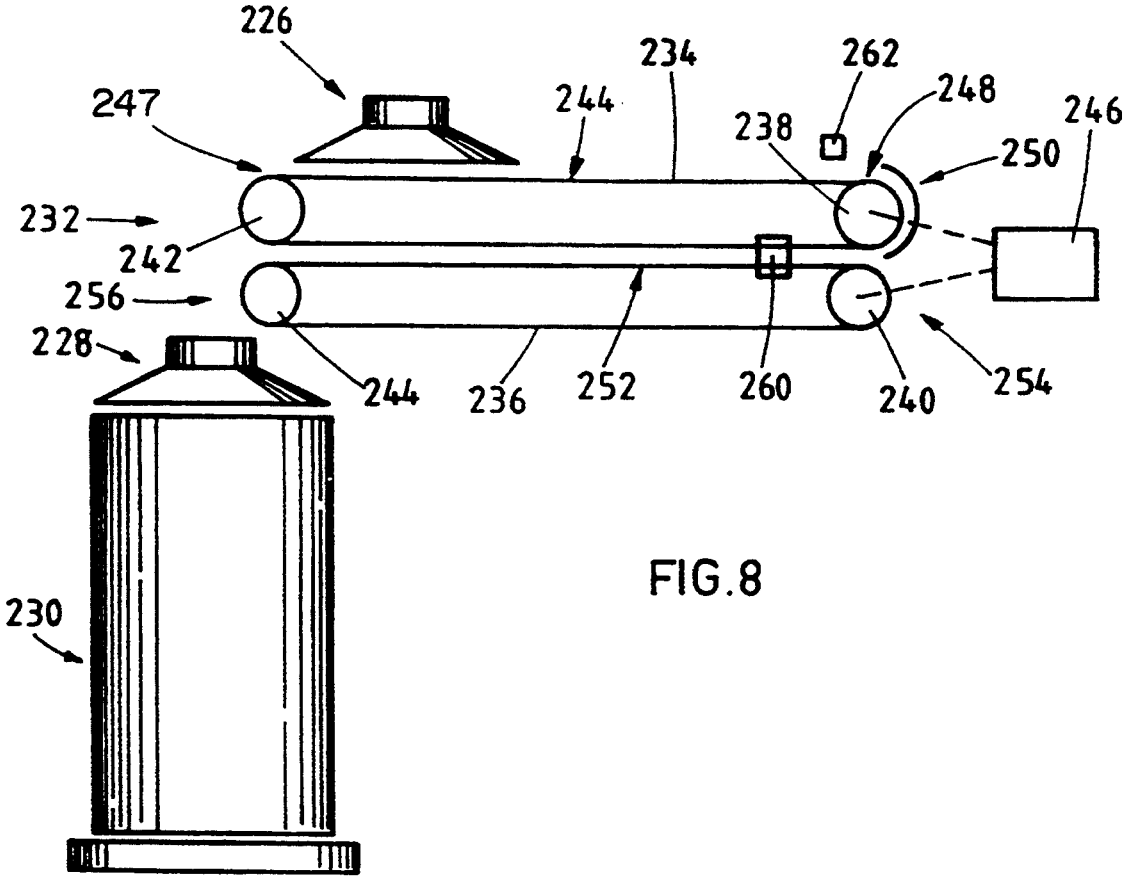
FIG. 8 shows a schematical view of a storage means in accordance with a second aspect of the present invention, which allows both controlling the delivery speed as well as "flying change" of the cans.

FIG. 8 shows a first funnel wheel 226 of conventional design, as is shown, for example, on page 3 of volume 3 of the handbook "Short Staple Spinning" (title of the volume: "A Practical Guide to Combing and Drawing") published by the Textile Institute, a funnel wheel 228 of a can press (not shown) for filling a can 230 and a conveyor belt arrangement 232. This arrangement serves as the storage means for the sliver supplied by a drafting device (not shown). This drafting device is a high-speed drafting device with a maximum supply speed of more than 600 m/min. The drafting device architecture can be arranged in accordance with our EP Patent 62185, but it can also have another, more conventional design, as was shown, for example, in our European Patent Application No. 376002 for the combing machine. The sliver coming from the drafting device is supplied to the funnel wheel 226.

The storage means 232 comprises two conveyor belts 234, 236 which are each guided over a driving roller 238, 240 and a deflection roller 242, 244. The rollers 238, 240 are jointly driven by a motor 246 in order to maintain the rotation of the conveyor belts about the pairs of rollers 238, 242 or 240, 244.

The rollers 238, 242 are each carried by a frame (not shown) in such a manner that a strand 244 of the conveyor belt 234 forms a horizontal receiver surface for the sliver supplied by the funnel wheel 226. Sliver loops form on the conveyor belt by the rotation of the funnel wheel 226 and the even conveyance of the sliver from the feed end 247 (below the funnel wheel 226) to the delivery end 248.

At the delivery end 248 of the upper conveyor belt 234 the sliver is guided downwards by means of a deflection means 250 on to the upper strand 252 of the conveyor belt 236. The rollers 240, 244 of said conveyor belt are carried in such a way that the upper strand 252 is substantially parallel to the upper strand 244 of the upper conveyor belt 234 and extends from the receiving end 254 to the delivery end 256 of the lower conveyor belt. The sliver supplied at the delivery end 256 is fed to the can 230 by means of a conventional funnel wheel 228.

In normal operation the sliver loops formed on the upper strand 244 and supplied to the strand 252 by means of the deflection means 250 are dissolved up to the delivery end of the strand 252. For this purpose the operating speeds of the conveyor belts 234, 236 are adjusted to the intake speed of the can press. If the drive of the drafting device is arranged in accordance with the first aspect of the invention (which is preferable), the short wave changes in the delivery speed of the sliver (caused by the control work) are compensated in the storage means 232 without any problems.

When changing the can it is necessary to switch off the withdrawal of sliver from the storage means 232 by the can press. During this short period the sliver loops are no longer stretched on the strand 252, but they retain the shape they had when they were supplied by the conveyor belt 234. This constitutes an increase of the amount of sliver in the storage means 232.

After changing the can, the can press begins to stretch the sliver loops on the strand 252 again. At an ascertainable position (e.g. 260) on the upper strand 252 of the conveyor belt 236 only a length of sliver aligned in longitudinal direction of the conveyor belt should be present when the cans are changed, but not a loop. In order to verify whether this is the case or not, a suitable sensor can be provided at the position 260 to supply the central control unit with the respective information.

In contrast to this, no stretching, for example, should take place on the uppermost strand 244. Whether this is the case or not can also be determined by placing a sensor at a suitable position (e.g. 262) on the uppermost strand 244 in order to supply the central control unit with the respective information.

In the event that an undesirable condition is noticed at the one or the other position 260, 262, the controller can intervene by means of a speed adjustment in order to correct the erroneous condition. As was already described in FIGS. 7A and 7B, this includes a change in the mean supply speed of the drafting device and/or a change in the intake speed of the can press. In this case, however, there is also the additional option to carry out certain adjustments by changing the running speed of the upper and/or lower conveyor belt.

Figure 9:
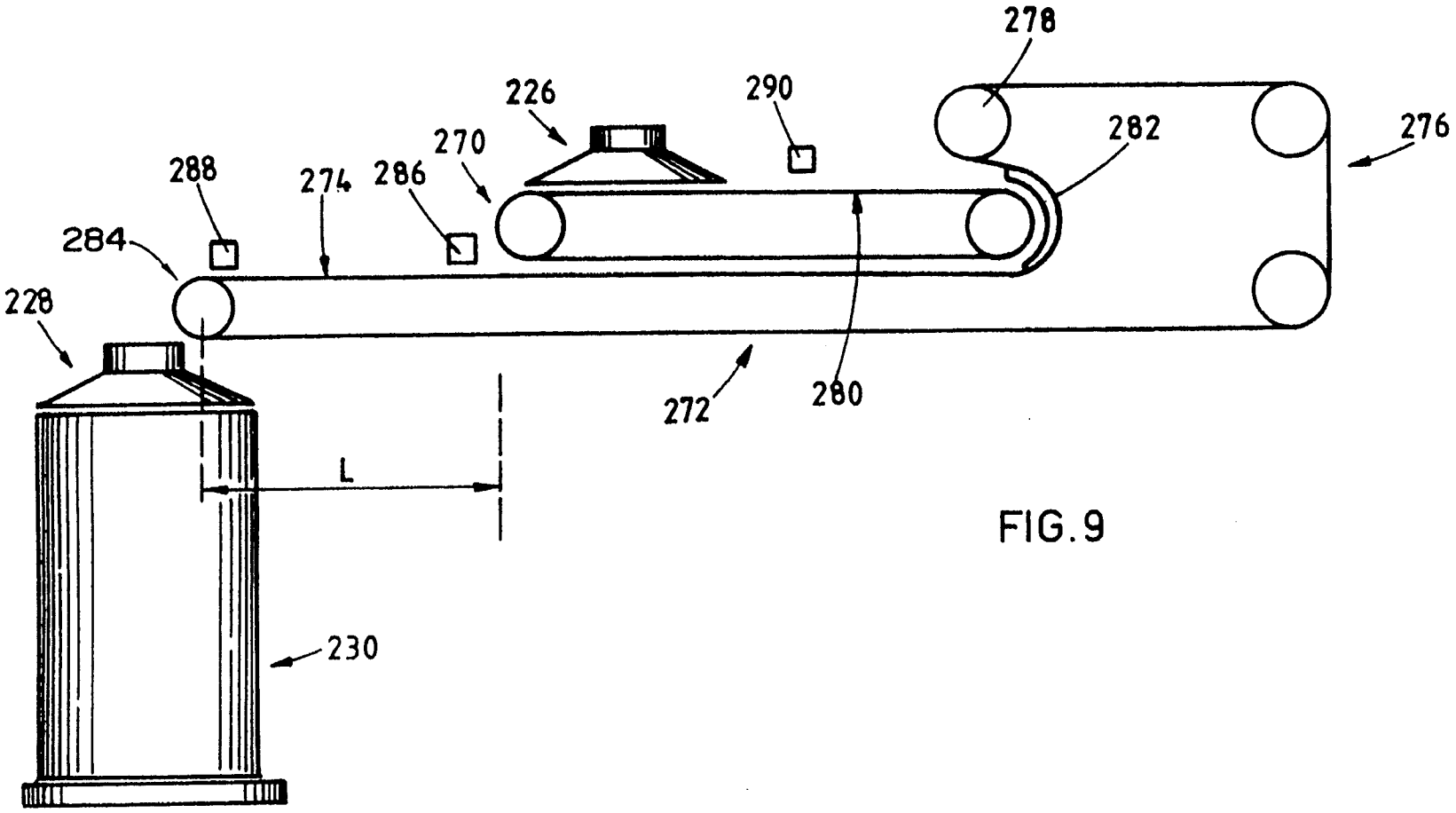
FIG. 9 shows a further variation of the arrangement in accordance with FIG. 8.

FIG. 9 shows a variation of the arrangement in accordance with FIG. 8, in which the upper conveyor belt 270 is relatively short and only covers a part of the upper strand 274 of the lower conveyor belt 272. The end section 276 of the lower conveyor belt 272 is bent upwardly in the vicinity of the conveyor belt 270 and runs around an end deflection roller 278 which extends above of and parallel to the upper strand 280 of the conveyor belt 270.

The conveyor belt 272 can be arranged slightly wider than the conveyor belt 270 and it runs around lateral, bent guiding means 282 (only one guiding means is visual in FIG. 9), so that a predetermined distance between the opposite surfaces of the conveyor belts 270 and 272 can be maintained. The bent section 276 of the lower conveyor belt 272 only serves as the deflection (only schematically outlined in FIG. 8) for the sliver loops.

The upper strand 280 of the conveyor belt 270 is, however, only long enough to form sliver loops and to forward them cleanly to the deflection means. The loops are then guided from the upper strand 274 to the lower conveyor belt by the cooperation between the two conveyor belts. At the same time, the distance between the conveyor belts defined by the guiding means 282 is maintained to the extent that the clear guiding of the loops is ensured without having them squeezed. The running speeds of the conveyor belts must be adjusted to one another in such a way that there is no relative movement of the areas opposite one another in the deflection means in order to avoid the twisting of the slivers.

After the loops have passed the deflection means, it is no longer necessary to guide them through two different conveyor belts. They can lie only on the upper strand 274 of the lower conveyor belt 272 until they are dissolved by the traction force exerted by the can press. This, however, should occur only after the loops have left the space between the conveyor belts. The path L of the strand 274 between the end of the upper conveyor belt 270 and the delivery end 284 of the lower conveyor belt 272 serves here as the storage means for the sliver length which is collected in the buffer during the change of the can.

A sensor 286 is attached above the strand 274 in the vicinity of the conveyor belt 270 and monitors the condition of the loops on the respective storage portion of the strand 274. If the loops should begin to dissolve in this storage segment, a control unit (not shown) responding to the sensor should adjust the speeds in such a way that a slower stretch of the loops is ensured. If, on the other hand, a sensor 288 notices in the vicinity of the delivery end 284 that undissolved sliver loops are still present in its storage segment, a speed adjustment (in the other sense) should take place. Within certain limits such speed adjustments can be carried out by changes in the running speeds of the conveyor belts, which causes a change in the "depositing angle" of the loops in respect of the longitudinal direction of the conveyor belts.

The upper strand 280 of the conveyor belt 270 now serves as a storage means in the sense of the storage means 214 of the variations in accordance with FIGS. 7A and 7B, i.e. in order to begin a compensation of the smaller changes in the supply speed of the drafting device (not shown) caused by the controlled delivery rollers. If necessary, a sensor 290 can be provided above the strand 280 in order to monitor the depositing angle of the newly formed loops and to bring about controlled changes of the respective speeds (drafting device, can press, storage means) if a continuous misadjustment is noticed.

The funnel wheels 226 or 228 and the can press 230 remain unchanged with respect to the variation of FIG. 8 and therefore are marked with the same drawing references. The funnel wheel 226 could, however, be replaced by a linear reciprocating guiding member of a traverse.

The U.S. Pat. No. 4,653,153 (CH-668 781) shows a combined control and regulating system for a drafting device in which the transmission time delays for the control signals can be optimized. Such delays are necessary because the feed material, for example, is measured in the feed measuring member 9.1 (FIG. 1), whereas the corrections can only be made a little later in the main drafting zone 12 (FIG. 1). The optimization of this time delay is truly important for the correction of high-frequency mass fluctuations. These fluctuations have to be determined by the feed measuring member.

The optimization of the time delay, however, is very difficult and tricky in the event that the feed speed is changed (which is exclusively the case in present autoleveller draw frames) in order to carry out the necessary changes in the draft. On its way from the feed measuring member to the main drafting zone the material is subjected to continuously changing speeds, so that a precise determination of the "correct" delay is practically impossible.

In accordance with the present invention this problem can be solved in an autoleveller draw frame considerably easier. The optimization of the time delay is naturally still necessary, whereby, however, one can start out from known or ascertainable conditions of the drive system between the feed measuring member and the main drafting zone.

We claim:

1. An apparatus for producing and storing a sliver, said apparatus comprising:

(a) a drafting device comprising:
  (1) a feed zone comprising:
    (i) means for introducing at least one preliminary sliver to said drafting device; and
    (ii) a sliver mass measuring unit;
  (2) a predrafting zone and a main drafting zone;
  (3) means for delivering a drafted sliver from said drafting device at a supply speed;
  (4) means for driving said drafting device at a feed speed;
  (5) a control unit, said control unit comprising means for controlling said driving means as a function of measurements made by said mass measuring unit for reducing mass fluctuations sensed by said mass measuring unit by changing said driving of said main drafting zone, said changing of said driving of said main drafting zone also changing said supply speed; and (b) a storage device for storing a variable amount of said drafted sliver delivered by said drafting device;

(c) means for sensing an amount of said drafted sliver in said storage device; and (d) a can press for receiving said drafted sliver from said storage device at an intake speed, wherein said means for driving said drafting device further comprises means for driving said can press;

said control unit comprising means for controlling said drafting device driving means in response to said means for sensing, for maintaining an amount of said drafted sliver in said storage device within a predetermined range, and said means for controlling comprising means for controlling a change in at least said feed speed of said drafting device.

2. An apparatus according to claim 1, wherein said means for controlling said driving means comprises means for maintaining constant said intake speed of said drafted sliver to said can press.

3. An apparatus according to claim 1, wherein said means for controlling said driving means comprises means for controlling changes of both said feed speed and said intake speed of said drafted sliver to said can press.

4. An apparatus for producing and storing a sliver, said apparatus comprising:

(a) a drafting device comprising:
  (1) a feed zone comprising:
    (i) means for introducing at least one preliminary sliver to said drafting device; and
    (ii) a sliver mass measuring unit;
  (2) a predrafting zone and a main drafting zone;
  (3) means for delivering a drafted sliver from said drafting device at a supply speed;

(4) means for driving said drafting device at a feed speed;

(5) a control unit, said control unit comprising means for controlling said driving means as a function of measurements made by said mass measuring unit for reducing mass fluctuations sensed by said mass measuring unit by changing said driving of said main drafting zone, said changing of said driving of said main drafting zone also changing said supply speed; and (b) a storage device for storing a variable amount of said drafted sliver delivered by said drafting device, said storage device comprising means for forming a hanging loop of a variable length;

(c) means for sensing an amount of said drafted sliver in said storage device, said means for sensing comprising means for sensing an extension in a length of said hanging loop; and (d) a can press for receiving said drafted sliver from said storage device at an intake speed, wherein said means for driving said drafting device further comprises means for driving said can press;

said control unit comprising means for controlling said driving means in response to said means for sensing, for maintaining an amount of said drafted sliver in said storage device within a predetermined range, and said means for controlling comprising means for controlling a change in at least said feed speed of said drafting device.

5. An apparatus comprising:

a drafting device for producing a sliver at a controlled supply speed; and a storage device for receiving said sliver from said drafting device at said controlled supply speed, for transporting said sliver toward a can press and for delivering said sliver to said can press, said can press including a can for receiving said sliver, said storage device comprising means for terminating said delivering of said sliver to said can press while continuing to receive said sliver from said drafting device and while continuing to transport said sliver by means of said storage device, while said drafting device continues to produce said sliver at said controlled supply speed and while said can is replaced with another can.

6. An apparatus according to claim 5, further comprising means for maintaining said controlled supply speed constant.

7. An apparatus according to claim 5, further comprising means for controlling a change in said supply speed in response to an amount of said sliver in said storage device.

8. An apparatus comprising:

a drafting device for producing a sliver at a controlled supply speed; and a storage device for receiving said sliver from said drafting device at said controlled supply speed and for delivering said sliver to a can press, said can press including a can for receiving said sliver, said storage device comprising means for terminating said delivering of said sliver to said can press while continuing to receive said sliver from said drafting device, while said drafting device continues to produce said sliver at said controlled supply speed and while said can is replaced with another can;

wherein said storage device comprises at least one conveyor belt and means for forming loops of said sliver on said conveyor belt.

9. An apparatus according to claim 8, wherein said storage device comprises at least a first conveyor belt and a second conveyor belt, said first conveyor belt being positioned above the second conveyor belt, and a deflector for transferring the loops of said sliver from said first conveyor belt to said second conveyor belt.

10. An apparatus according to claim 8, further comprising means for monitoring an amount of sliver loops in said storage device.

* * * * *